US010987548B2

(12) United States Patent
Watanabe

(10) Patent No.: US 10,987,548 B2
(45) Date of Patent: Apr. 27, 2021

(54) MULTI-PIECE SOLID GOLF BALL

(71) Applicant: Bridgestone Sports Co., Ltd., Tokyo (JP)

(72) Inventor: Hideo Watanabe, Saitamaken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 16/845,363

(22) Filed: Apr. 10, 2020

(65) Prior Publication Data

US 2020/0330829 A1 Oct. 22, 2020

(30) Foreign Application Priority Data

Apr. 22, 2019 (JP) ..... JP2019-081161

(51) Int. Cl.
*A63B 37/06* (2006.01)
*A63B 37/00* (2006.01)

(52) U.S. Cl.
CPC ..... *A63B 37/0092* (2013.01); *A63B 37/0022* (2013.01); *A63B 37/0063* (2013.01); *A63B 37/0075* (2013.01); *A63B 37/0076* (2013.01); *A63B 37/0087* (2013.01)

(58) Field of Classification Search
CPC ..... A63B 37/0081; A63B 37/0087; A63B 37/0065; A63B 37/0046; A63B 37/0022
USPC ..... 473/373
See application file for complete search history.

(56) References Cited

U.S. PATENT DOCUMENTS

| | | | | |
|---|---|---|---|---|
| 9,278,260 | B1 | 3/2016 | Bartels | |
| 2011/0143861 | A1 | 6/2011 | Watanabe et al. | |
| 2011/0224024 | A1* | 9/2011 | Tutmark | A63B 37/0022 473/378 |
| 2013/0196790 | A1* | 8/2013 | Umezawa | A63B 37/002 473/377 |
| 2013/0217516 | A1* | 8/2013 | Komatsu | A63B 37/0003 473/374 |
| 2013/0225333 | A1* | 8/2013 | Umezawa | A63B 37/002 473/374 |
| 2016/0175660 | A1 | 6/2016 | Watanabe et al. | |
| 2016/0354644 | A1 | 12/2016 | Watanabe et al. | |
| 2016/0361605 | A1* | 12/2016 | Watanabe | A63B 37/0092 |

(Continued)

FOREIGN PATENT DOCUMENTS

| | | | |
|---|---|---|---|
| JP | 2011-120898 | A | 6/2011 |
| JP | 2016-112308 | A | 6/2016 |

(Continued)

*Primary Examiner* — Raeann Gorden
(74) *Attorney, Agent, or Firm* — Sughrue Mion, PLLC

(57) ABSTRACT

In a multi-piece solid golf ball having a core formed of a rubber composition, an intermediate layer formed of a polyurethane material and a cover, the ball satisfies the following condition: surface hardness of ball≤surface hardness of intermediate layer-encased sphere. When the ball is struck with a driver at a head speed of 40 m/s, the sum of the time t1 required from contact initiation between the driver and ball for deformation of the ball to reach a maximum value and the time t2 required from the state of maximum ball deformation for the ball and driver clubface to separate is at least 705 microseconds. This ball has an excellent flight performance when hit by low or moderate head-speed golfers, is receptive to spin on approach shots and has a good, soft feel at impact.

9 Claims, 1 Drawing Sheet

(56) References Cited

U.S. PATENT DOCUMENTS

| | | | | |
|---|---|---|---|---|
| 2017/0182372 | A1* | 6/2017 | Watanabe | A63B 37/004 |
| 2017/0203160 | A1 | 7/2017 | Bartels | |

FOREIGN PATENT DOCUMENTS

| | | | |
|---|---|---|---|
| JP | 2017-000183 | A | 1/2017 |
| JP | 2017-000470 | A | 1/2017 |
| JP | 2018-512951 | A | 5/2018 |

* cited by examiner

MULTI-PIECE SOLID GOLF BALL

CROSS-REFERENCE TO RELATED APPLICATION

This non-provisional application claims priority under 35 U.S.C. § 119(a) on Patent Application No. 2019-081161 filed in Japan on Apr. 22, 2019, the entire contents of which are hereby incorporated by reference.

TECHNICAL FIELD

The present invention relates to a golf ball having a core, an intermediate layer and a cover which is intended for amateur golfers whose head speeds are not fast.

BACKGROUND ART

Key performance features required in a golf ball include distance, controllability, durability and feel at impact. Balls endowed with these qualities in the highest degree are constantly being sought. Among recent golf balls, there has emerged a succession of balls which have multilayer structures typically consisting of three pieces (or layers). By giving the golf ball a multilayered structure, it is possible to combine several materials of differing properties, enabling a wide variety of ball designs to be obtained in which each layer has a particular function.

Of these, functional multi-piece solid golf balls having an optimized hardness relationship among the layers encasing the core, such as an intermediate layer and a cover (outermost layer), are widely used. For example, golf balls which have three or more layers, including at least a core, an intermediate layer and a cover, and which are focused on design attributes such as the core diameter, the intermediate layer and cover thicknesses, the deflection of the core under specific loading and the hardnesses of the respective layers are described in JP-A 2011-120898, JP-A 2016-112308, JP-A 2017-183, JP-A 2017-470, JP-A 2018-512951, and also in U.S. Published Patent Application No. 2017/0203160.

However, with these golf balls, the distance achieved by golfers whose head speeds are not fast still leaves something to be desired. Moreover, in some of these golf balls, the spin rate of the ball on approach shots is insufficiently large and so the ball does not provide a competitive edge in the short game. In addition, some of these balls lack a good feel when struck with a driver, Hence, in terms of all the key performance features desired in golf balls, such balls are not always satisfactory to golfers of moderate head speeds.

SUMMARY OF THE INVENTION

It is therefore an object of the present invention to provide a golf ball which achieves superior distances when hit with a driver (W#1) and a middle/long iron by amateur golfers whose head speeds are not fast, which has a high spin rate on approach shots and thus provides a competitive edge in the short game, and moreover which has a soft, comfortable feel at impact.

As a result of intensive investigations, the inventors have discovered that, in a multi-piece solid golf ball having a core, an intermediate layer and a cover, when a rubber composition is used as the core material and a polyurethane material is used as the resin material for the cover, when the relationship between the surface hardness of the ball and the surface hardness of the sphere consisting of the core encased by the intermediate layer (intermediate layer-encased sphere) satisfies the following condition:

surface hardness (Shore *C* hardness) of ball≤surface hardness (Shore *C* hardness) of intermediate layer-encased sphere, and moreover when the ball is produced is such a way that, in an impact test carried out by striking the ball with a driver at a head speed of 40 m/s, the sum t1+t2 of the time t1 required from contact initiation between the driver and the ball for deformation of the ball to reach a maximum value and the time t2 required from the state of maximum ball deformation for the ball and driver clubface to separate is at least 705 microseconds, the ball exhibits a good flight performance when hit with a driver (W#1) and a number six iron (middle/long iron) by golfers whose head speeds are not fast, is receptive to spin on approach shots and thus provides a competitive edge in the short game, enables a good, soft feel to be obtained, and moreover has scuff resistance.

Accordingly, the invention provides a multi-piece solid golf ball having a core, an intermediate layer and a cover, wherein the core is formed of a rubber composition, the cover is formed primarily of a polyurethane material, the ball has a surface hardness and the sphere obtained by encasing the core with the intermediate layer (intermediate layer-encased sphere) has a surface hardness which together satisfy the following condition surface hardness (Shore *C* hardness) of ball≤surface hardness (Shore *C* hardness) of intermediate layer-encased sphere, and in an impact test carried out by striking the ball with a driver at a head speed of 40 m/s, the sum t1+t2 of the time t1 required from contact initiation between the driver and the ball for deformation of the ball to reach a maximum value and the time t2 required from the state of maximum ball deformation for the ball and driver clubface to separate is at least 705 microseconds.

In a preferred embodiment of the golf ball of the invention, the ratio t2/t1 between deformation time t1 and deformation time t2 is at least 1.35.

In another preferred embodiment of the inventive golf ball, the ball has a deflection of at least 3.8 mm when compressed under a final load of 1,275 N (130 kgf) from an initial load of 98 N (10 kgf).

In yet another preferred embodiment, the core has a center hardness Cc and a surface hardness Cs such that the difference therebetween (Cs−Cc) on the Shore C hardness scale is at least 20.

In a further preferred embodiment, the core has a hardness profile in which, letting Cc be the Shore C hardness at the core center, Cs be the Shore C hardness at a surface of the core, $C_M$ be the Shore C hardness at a midpoint M between the center and surface of the core, $C_{M+2.5}$, $C_{M+5.0}$ and $C_{M+7.5}$ be the respective Shore C hardnesses at positions 2.5 mm, 5.0 mm and 7.5 mm from the midpoint M toward the core surface side and $C_{M-2.5}$, $C_{M-5.0}$ and $C_{M-7.5}$ be the respective Shore C hardnesses at positions 2.5 mm, 5.0 mm and 7.5 mm from the midpoint M toward the core center side, the following surface areas A to F:

surface area A: $\frac{1}{2}\times 2.5\times(C_{M-5.0}-C_{M-7.5})$
surface area B: $\frac{1}{2}\times 2.5\times(C_{M-2.5}-C_{M-5.0})$
surface area C: $\frac{1}{2}\times 2.5\times(C_{M}-C_{M-2.5})$
surface area D: $\frac{1}{2}\times 2.5\times(C_{M+2.5}-C_{M})$
surface area E: $\frac{1}{2}\times 2.5\times(C_{M+5}-C_{M+2.5})$
surface area F: $\frac{1}{2}\times 2.5\times(C_{M+7.5}-C_{M+5})$ satisfy the condition (surface area $D$+surface area $E$+surface area $F$)−(surface area $A$+surface area $B$+surface area $C$)>0.

In the same embodiment, surface areas A to F in the core hardness profile may satisfy the condition (surface area $D$+surface area $E$)−(surface area $A$+surface area $B$+surface area $C$)≥0.

In this embodiment, surface areas A to F in the core hardness profile may satisfy the condition 0<[(surface area $D$+surface area $E$+surface area $F$)−(surface area $A$+surface area $B$+surface area $C$)]/($Cs-Cc$)≤0.60.

In another preferred embodiment of the inventive golf ball, the cover has a surface on which a coating layer is formed, which coating layer has a Shore C hardness of from 40 to 80. The value obtained by subtracting the Shore C hardness of the coating layer from a Shore C material hardness of the cover is preferably at least −20 and not more than +30.

In still another preferred embodiment, letting A be the deflection of the core in millimeters when compressed under a final load of 1,275 N (130 kgf) from an initial load of 98 N (10 kgf) and B be the deflection of the ball in millimeters when compressed under a final load of 130 kgf from an initial load of 10 kgf, the ratio B/A is at least 0.60 and not more than 0.81.

ADVANTAGEOUS EFFECTS OF THE INVENTION

The golf ball of the invention has an excellent flight performance when struck by golfers whose head speeds are not very fast, is receptive to spin on approach shots and thus provides a competitive edge in the short game, and moreover has a good, soft feel at impact, making it suitable for use by amateur golfers. In addition, the golf ball of the invention does not scuff easily, enabling its prolonged use.

BRIEF DESCRIPTION OF THE DIAGRAMS

DESCRIPTION OF THE PREFERRED EMBODIMENTS

The objects, features and advantages of the invention will become more apparent from the following detailed description taken in conjunction with the appended diagrams.

Figure 1:
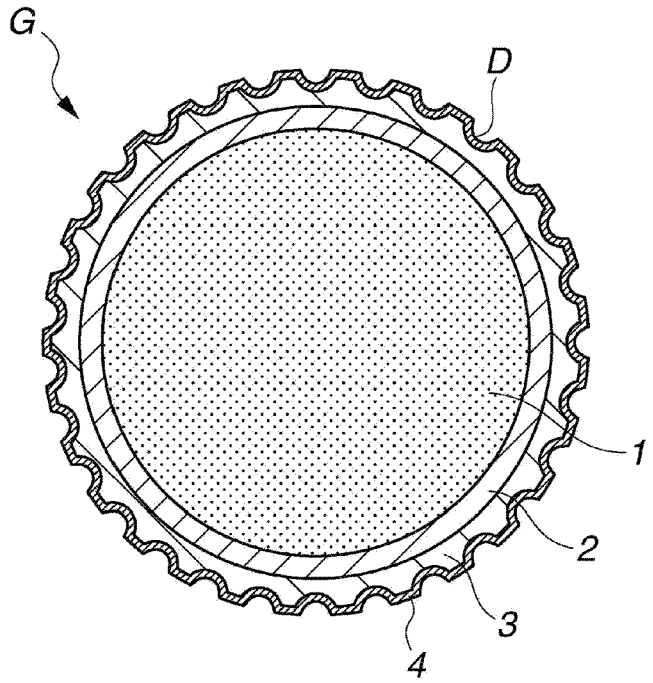
FIG. 1 is a schematic cross-sectional view of a golf ball according to an embodiment of the invention.

The multi-piece solid golf ball of the invention has a core, an intermediate layer and a cover. Referring to FIG. 1, which shows an embodiment of the inventive golf ball, the golf ball G has a core 1, an intermediate layer 2 encasing the core 1, and a cover 3 encasing to the intermediate layer 2. Aside from a coating, layer, the cover 3 serves as the outermost layer in the layer structure of the golf ball. Numerous dimples D are typically formed on the surface of the cover (outermost layer) 3 so as to enhance the aerodynamic properties of the ball. A coating layer 4 is formed on the surface of the cover 3.

The core has a diameter which is preferably at least 37.1 mm, more preferably at least 37.7 mm, and even more preferably at least 38.1 mm. The upper limit is preferably not more than 39.9 mm, more preferably not more than 39.3 mm, and even more preferably not more than 38.7 mm. When the core diameter is too small, the spin rate of the ball on shots with a driver (W#1) rises and it may not be possible to achieve the intended distance. On the other hand, when the core diameter is too large, the durability of the ball to repeated impact may worsen or the feel at impact may worsen.

The core has a deflection when compressed under a final load of 1,275 N (130 kgf) from an initial load of 98 N (10 kgf) which, although not particularly limited, is preferably at least 4.5 mm, more preferably at least 5.0 mm, and even more preferably at least 5.3 mm. The upper limit is preferably not more than 7.0 mm, more preferably not more than 6.5 mm, and even more preferably not more than 6.0 mm. When the core deflection is too small, i.e., when the core is too hard, the spin rate of the ball may rise excessively, resulting in a poor flight, or the feel at impact may be too hard. On the other hand, when the core deflection is too large, i.e., when the core is too soft, the rebound may be too low, resulting in a poor flight, the feel at impact may be too soft, or the durability to cracking on repeated impact may worsen.

Next, the hardness profile of the core is explained. The core hardnesses mentioned below refer to values on the Shore C hardness scale. These Shore C hardnesses are hardness values measured with a Shore C durometer in general accordance with ASTM D2240.

The core has a center hardness (Cc) which is preferably at least 40, more preferably at least 42, and even more preferably at least 44. The upper limit is preferably not more than 54, more preferably not more than 52, and even more preferably not more than 50. When this value is too large, the feel at impact becomes hard, or the spin rate on full shots rises, as a result of which the intended distance may not be achieved. On the other hand, when this value is too small, the rebound decreases and a good flight is not achieved, or the durability to cracking on repeated impact may worsen.

The core has a surface hardness (Cs) which is preferably at least 66, more preferably at least 68, and even more preferably at least 70. The upper limit is preferably not more than 80, more preferably not more than 78, and even more preferably not more than 76. Hardnesses outside of this range may lead to the same undesirable results as mentioned above for the core center hardness (Cc).

The difference between the core surface hardness (Cs) and the core center hardness (Cc) is preferably at least 20, more preferably at least 22, and even more preferably at least 24. The upper limit is preferably not more than 35, more preferably not more than 32, and even more preferably not more than 28. When this value is too small, the ball spin rate-lowering effect on shots with a driver is inadequate, as a result of which a good distance may not be achieved. When this value is too large, the initial velocity of the ball when struck becomes lower, as a result of which a good distance may not be achieved, or the durability to cracking on repeated impact may worsen.

Figure 2:
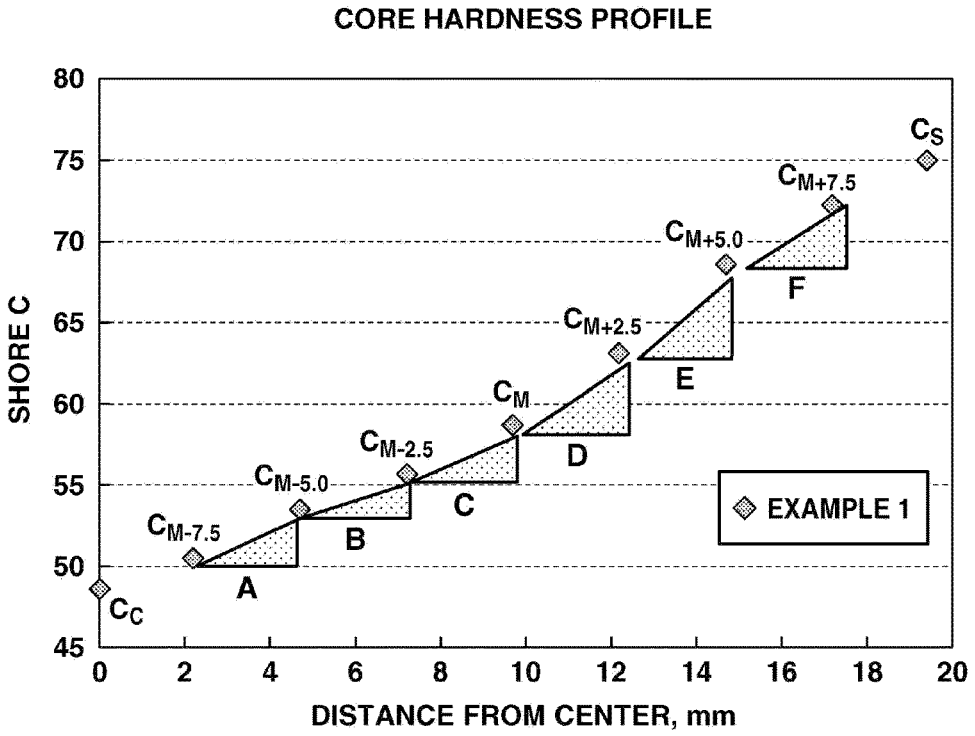
FIG. 2 is a graph that uses core hardness profile data from Example 1 to explain surface areas A to F in the core hardness profile.

In the above core hardness profile, letting Cc be the Shore C hardness at the core center, Cs be the Shore C hardness at the core surface, $C_M$ be the Shore C hardness at a midpoint M between the center and the surface of the core, $C_{M+2.5}$, $C_{M+5.0}$ and $C_{M+7.5}$ be the respective Shore C hardnesses at positions 2.5 mm, 5.0 mm and 7.5 mm from the midpoint M toward the core surface side and $C_{M-2.5}$, $C_{M-5.0}$ and $C_{M-7.5}$ be the respective Shore C hardnesses at positions 2.5 mm, 5.0 mm and 7.5 mm from the midpoint M toward the core center side, the following surface areas A to F:

surface area A: $\frac{1}{2}\times2.5\times(C_{M-5.0}-C_{M-7.5})$ surface area B: $\frac{1}{2}\times2.5\times(C_{M-2.5}-C_{M-5.0})$ surface area C: $\frac{1}{2}\times2.5\times(C_{M}-C_{M-2.5})$ surface area D: $\frac{1}{2}\times2.5\times(C_{M+2.5}-C_{M})$ surface area E: $\frac{1}{2}\times2.5\times(C_{M+5}-C_{M+2.5})$ surface area F: $\frac{1}{2}\times2.5\times(C_{M+7.5}-C_{M+5})$ are preferably such that the value of (surface area D+surface area E+surface area F)−(surface area A+surface area B+surface area C) satisfies the specific range described below. FIG. 2 shows a graph that uses core hardness profile data from Example 1 to explain surface areas A to F. Each of surface areas A to F is the surface area of a triangle whose base is the difference between specific distances in the core cross-section and whose height is the difference in hardness between positions at these specific distances.

The value of (surface area D+surface area E+surface area F)−(surface area A+surface area B+surface area C) above is preferably more than 0, more preferably at least 0.5, and even more preferably at least 1. Although not particularly limited, this value is preferably not more than 20, more preferably not more than 15, and even more preferably not more than 7. When this value is too small, the spin rate for effect on shots with a drive (W#1) may be inadequate, as a result of which a good distance may not be achieved. When this value is too large, the initial velocity of the ball when struck may become lower, resulting in a poor distance, or the durability to cracking on repeated impact may worsen.

In the above core hardness profile, it is preferable for the following condition to be satisfied:

$$0<[(\text{surface area } D+\text{surface area } E+\text{surface area } F)-(\text{surface area } A+\text{surface area } B+\text{surface area } C)]/(Cs-Cc)\leq 0.60.$$

The lower limit value here is preferably at least 0.02, and more preferably at least 0.04. The upper limit value in this formula is preferably not more than 0.45, and more preferably not more than 0.30. When this value is too small, the spin rate-lowering effect on shots with a driver (W#1) may be inadequate and so a good distance may not be achieved. On the other hand, when this value is too large, the initial velocity of the ball when struck may be low, resulting in a poor distance, or the durability to cracking on repeated impact may worsen.

In addition, in the above core hardness profile, it is preferable for the following condition to be satisfied:

$$(\text{surface area } D+\text{surface area } E)-(\text{surface area } A+\text{surface area } B+\text{surface area } C)\geq 0.$$

The lower limit value here is preferably at least 0.1, and mare preferably at least 0.2. The upper limit value is preferably not more than 8.0, more preferably not more than 6.0, and even more preferably not more than 4.0. When this value is too small, the spin rate-lowering effect on shots with a driver (W#1) may be inadequate, and so mood distance may not be achieved. On the other hand, when this value is too large, the initial velocity of the ball when struck may become lower, resulting in a poor distance, or the durability to cracking on repeated impact may worsen.

The core in this invention is formed of a single layer or a plurality of layers of rubber material. A rubber composition can be prepared as this core-forming, rubber material by using a base rubber as the chief component and including together with this other ingredients such as a co-crosslinking agent, an organic peroxide, an inert filler and an organosulfur compound. It is preferable to use polybutadiene as the base rubber.

Commercial products may be used as the polybutadiene. Illustrative examples include BR730, BR01 and BR51 (all products of JSR Corporation). The proportion of polybutadiene within the base rubber is preferably at least 60 wt %, and more preferably at least 80 wt %. Rubber ingredients other than the above polybutadienes may be included in the base rubber, provided that doing so does not detract from the advantageous effects of the invention. Examples of rubber ingredients other than the above polybutadienes include other polybutadienes and also other diene rubbers, such as styrene-butadiene rubbers, natural rubbers, isoprene rubbers and ethylene-propylene-diene rubbers.

Examples of co-crosslinking agents include unsaturated carboxylic acids and metal salts of unsaturated carboxylic acids. Specific examples of unsaturated carboxylic acids include acrylic acid, methacrylic acid, maleic acid and fumaric acid. The use of acrylic acid or methacrylic acid is especially preferred. Metal salts of unsaturated carboxylic acids are exemplified by, without particular limitation, the above unsaturated carboxylic acids that have been neutralized with desired metal ions. Specific examples include the zinc salts and magnesium salts of methacrylic acid and acrylic acid. The use of zinc acrylate is especially preferred.

The unsaturated carboxylic acid and/or metal salt thereof is included in an amount, per 100 parts by weight of the base rubber, which is typically at least 5 parts by weight, preferably at least 10 parts by weight, and more preferably at least 13 parts by weight. The amount included is typically not more than 60 parts by weight, preferably not more than 50 parts by weight, and more preferably not more than 40 parts by weight. Too much may make the core too hard, giving the ball an unpleasant feel at impact, whereas too little may lower the rebound.

Commercial products may be used as the organic peroxide. Examples of such products that may be suitably used include Percumyl D. Perhexa C-40 and Perhexa 3M (all from NOF Corporation), and Luperco 231XL (from AtoChem Co.). One of these may be used alone, or two or more may be used together. The amount of organic peroxide included per 100 parts by weight of the base rubber is preferably at least 0.1 part by weight, more preferably at least 0.3 part by weight, even more preferably at least 0.5 part by weight, and most preferably at least 0.6 part by weight. The upper limit is preferably not more than 5 parts by weight, more preferably not more than 4 parts by weight, even more preferably not more than 3 parts by weight, and most preferably not more than 2.5 parts by weight. When too much or too little is included, it may not be possible to obtain a ball having a good feel, durability and rebound.

In addition, an antioxidant may be optionally included. Illustrative examples of suitable commercial antioxidants include Nocrac NS-6 and Nocrac NS-30 (both available from Ouchi Shinto Chemical Industry Co., Ltd.). One of these may be used alone, or two or more may be used together.

The amount of antioxidant included per 100 parts by weight of the base rubber is set to preferably at least 0.05 part by weight, and more preferably at least 0.1 part by weight. The upper limit is set to preferably not more than 3 parts by weight, more preferably not more than 2 parts by weight, even more preferably not more than 1 part by weight, and most preferably not more than 0.5 part by weight. Too much or too little antioxidant may make it impossible to achieve a suitable ball rebound and durability.

An organosulfur compound may be included in the core in order to impart a good resilience. The organosulfur compound is not particularly limited, provided it can enhance the rebound of the golf ball. Exemplary organosulfur compounds include thiophenols, thionaphthols, halogenated thiophenols, and metal salts of these. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol, and any of the following having 2 to 4 sulfur atoms: diphenylpolysulfides, dibenzylpolysulfides, dibenzoylpolysulfides, dibenzothiazoylpolysulfides and dithiobenzoylpolysulfides. The use of the zinc salt of pentachlorothiophenol is especially preferred.

The amount of organosulfur compound included per 100 parts by weight of the base rubber is 0 part by weight or more, and it is recommended that the amount be preferably at least 0.1 part by weight, and more preferably at least 0.2 part by weight, and that the upper limit be preferably not more than 5 parts by weight, more preferably not more than 3 parts by weight, and even more preferably not more than 2 parts by weight. Including too much organosulfur compound may make a greater rebound-improving effect (particularly on shots with a W#1) unlikely to be obtained, may make the core too soft or may worsen the feel of the ball at impact. On the other hand, including too little may make a rebound-improving effect unlikely.

In addition, water may be included in a suitable amount within the above core-foaming rubber composition. This water, although not particularly limited, may be distilled water or tap water. The use of distilled water that is free of impurities is especially preferred. The amount of water included per 100 parts by weight of the base rubber is preferably at least 0.1 part by weight, and more preferably at least 0.3 part by weight. The upper limit is preferably not more than 5 parts by weight, more preferably not more than 4 parts by weight, and even more preferably not more than 3 parts by weight.

By including a suitable amount of such water, the moisture content of the rubber composition before vulcanization becomes preferably at least 1,000 ppm, and more preferably at least 1,500 ppm. The upper limit is preferably not more than 8,500 ppm, and more preferably not more than 8,000 ppm. When the moisture content of the rubber composition is too low, it may be difficult to obtain a suitable crosslink density and tan δ, which may make it difficult to mold a golf ball that minimizes energy loss and has a reduced spin rate. On the other hand, when the moisture content of the rubber composition is too high, the core may be too soft, which may make it difficult to obtain a suitable core initial velocity.

Although it is also possible to add water directly to the rubber composition, the following methods (i) to (iii) may be employed to incorporate water:

(i) applying steam or water in the form of a mist (by means of ultrasound) to some or all of the rubber composition (compounded material);
(ii) immersing some or all of the rubber composition in water;
(iii) letting some or all of the rubber composition stand for a given period of time in a high-humidity environment in a place where the humidity can be controlled, such as a constant humidity chamber.

The "high-humidity environment" is not particularly limited, so long as it is an environment capable of moistening the rubber composition, although a humidity of from 40 to 100% is preferred.

Another compounding ingredient typically included with the base rubber is an inert filler, preferred examples of which include zinc oxide, barium sulfate and calcium carbonate. One of these may be used alone, or two or more may be used together. The amount of inert filler included per 100 parts by weight of the base rubber is preferably at least 1 part by weight, and more preferably at least 5 parts by weight. The upper limit is preferably not more than 50 parts by weight, more preferably not more than 40 parts by weight, and even more preferably not more than 35 parts by weight. Too much or too little inert filler may make it impossible to obtain a proper weight and a suitable rebound.

The core can be produced by vulcanizing/curing the rubber composition containing the above ingredients. For example, the core can be produced by intensively mixing the rubber composition using a mixing apparatus such as a Banbury mixer or a roll mill, subsequently compression-molding or injection-molding the mixture in a core mold, and then suitably heating and thereby curing the resulting molded body under conditions sufficient to allow the organic peroxide or co-crosslinking agent to act, such as at a temperature of between 100 and 200° C., preferably between 140 and 180° C., for 10 to 40 minutes.

The core may consist of a single layer alone, or may be formed as a two-layer core consisting of an inner core layer and an outer core layer. When the core is formed as a two-layer core consisting of an inner core layer and an outer core layer, the inner core layer and outer core layer materials may each be composed primarily of the above-described rubber material. The rubber material making up the outer core layer encasing the inner core layer may be the same as or different from the inner core layer material. The details here are the same as those given above for the ingredients of the core-forming rubber material.

Next, the intermediate layer is described.

The intermediate layer has a material hardness on the Shore D hardness scale which, although not particularly limited, is preferably at least 54, more preferably at least 58, and even more preferably at least 62, The upper limit is preferably not more than 72, more preferably not more than 69, and even more preferably not more than 66. The Shore C hardness is preferably at least 82, more preferably at least 87, and even more preferably at least 92. The upper limit is preferably not more than 100, more preferably not more than 98, and even more preferably not more than 97.

The sphere obtained by encasing the core with the intermediate layer (intermediate layer-encased sphere) has a surface hardness, expressed on the Shore D scale, of preferably at least 60, more preferably at least 64, and even more preferably at least 68. The upper limit is preferably not more than 78, more preferably not more than 75, and even more preferably not more than 72. The Shore C hardness is preferably at least 88, more preferably at least 93, and even more preferably at least 98. The upper limit is preferably not more than 100, more and preferably not more than 99.

When the material and surface hardnesses of the intermediate layer are lower than the above respective ranges, the spin rate of the ball on full shots may rise excessively, resulting in a poor distance, or the initial velocity of the ball may be low, as a result of which a good distance may not be achieved on full shots. On the other hand, when the material and surface hardnesses are too high, the durability to cracking on repeated impact may worsen or the feel at impact may worsen.

The intermediate layer has a thickness of preferably at least 0.9 mm, more preferably at least 1.1 mm, and even more preferably at least 1.2 mm. The upper limit in the intermediate layer thickness is preferably not more than 1.8 mm, more preferably not more than 1.6 mm, and even more preferably not more than 1.4 mm. When the intermediate layer is too thin, the durability to cracking on repeated impact may worsen or the spin rate of the ball on full shots with an iron may rise and a good distance may not be obtained. When the intermediate layer is too thick, the ball initial velocity may become low and a good distance may not be obtained, or the feel at impact may worsen.

Various types of thermoplastic resins that are employed as cover stock in golf balls, particularly ionomer resins and highly neutralized resin materials, may be suitably used as the material that forms the intermediate layer.

A commercial product may be used as the ionomer resin. Or, of commercially available ionomer resins, a high-acid ionomer resin having an acid content of at least 18 wt % blended into an ordinary ionomer resin may be used as the resin material for the cover. When the amount of such a high-acid ionomer resin included is too high, the durability to cracking under repeated impact may worsen.

The highly neutralized resin material is exemplified by resin compositions containing as the essential ingredients:

100 parts by weight of a resin component composed of, in admixture.

(A) a base resin of (a-1) an olefin-unsaturated carboxylic acid random copolymer and/or a metal ion neutralization product of an olefin-unsaturated carboxylic acid random copolymer mixed with (a-2) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (B) a non-ionomeric thermoplastic elastomer in a weight ratio between 100:0 and 50:50;

(C) from 5 to 80 parts by weight of a fatty acid and/or fatty acid derivative having a molecular weight of from 228 to 1,500; and (D) from 0.1 to 17 parts by weight of a basic inorganic metal compound capable of neutralizing un-neutralized acid groups in components A and C.

Components A to D in the intermediate layer-forming resin material described in, for example, JP-A 2010-253268 may be advantageously used as above components A to D.

A non-ionomeric thermoplastic elastomer may be included in the intermediate layer material. The amount of non-ionomeric thermoplastic elastomer included is preferably from 0 to 50 parts by weight per 100 parts by weight of the total amount of the base resin.

Exemplary non-ionomeric thermoplastic elastomers include polyolefin elastomers (including polyolefins and metallocene polyolefins), polystyrene elastomers, diene polymers, polyacrylate polymers, polyamide elastomers, polyurethane elastomers, polyester elastomers and polyacetals.

Depending on the intended use, optional additives may be suitably included in the intermediate layer material. For example, pigments, dispersants, antioxidants, ultraviolet absorbers and light stabilizers may be added. When these additives are included, the amount added per 100 parts by weight of the overall base resin is preferably at least 0.1 part by weight, and more preferably at least 0.5 part by weight. The upper limit is preferably not more than 10 parts by weight, and more preferably not more than 4 parts by weight.

Next, the cover is described.

The cover has a material hardness on the Shore D scale which, although not particularly limited, is preferably at least 27, more preferably at least 32, and even more preferably at least 38. The upper limit is preferably not more than 60, more preferably not more than 55, and even more preferably not more than 50. The Shore C hardness is preferably at least 46, more preferably at least 53, and even more preferably at least 61. The upper limit is preferably not more than 89, more preferably not more than 83, and even more preferably not more than 76.

The surface hardness of the cover (also referred to herein as the "ball surface hardness") on the Shore D hardness scale is preferably at least 33, more preferably at least 40, and even more preferably at least 55. The upper limit is preferably not more than 66, more preferably, not more than 63, and even more preferably not more than 60. The Shore C surface hardness is preferably at least 54, more preferably at least 63, and even more preferably at least 83. The upper limit is preferably not more than 97, more preferably not more than 93, and even more preferably not more than 89.

When these material and surface hardnesses are too high, the spin rate on full shots with a driver (W#1) or a middle/long iron may rise and a good distance may not be obtained. On the other hand, when these material and surface hardnesses are too low, the cover tends to scuff easily or the ball may not be receptive to spin on approach shots, sometimes resulting in an inferior short game.

The cover has a thickness of preferably at least 0.3 mm, more preferably at least 0.5 mm, and even more preferably at least 0.7 mm. The upper limit in the cover thickness is preferably not more than 1.2 mm, more preferably not more than 1.0 mm, and even more preferably not more than 0.8 mm. When this cover is too thin, molding the cover so as to encase the intermediate layer becomes difficult, which may lower the productivity, or the durability to cracking, on repeated impact may worsen. On the other hand, when the cover is too thick, the spin rate of the ball on full shots may rise excessively or the rebound of the ball may decrease, as a result of which a good distance may not be achieved.

Various types of thermoplastic resins employed as cover stock in golf balls may be used as the cover material although, compared with ionomer resins and the like, preferred use can be made of a urethane resin as the chief material because it does not scuff easily and the spin rate does not become too high, resulting in a superior flight. In particular, from the standpoint of the mass productivity of the manufactured balls, it is preferable to use a material that is composed primarily of a thermoplastic polyurethane, and more preferable to form the cover of a resin composition in which the main components are (I) a thermoplastic urethane and (II) a polyisocyanate compound.

It is recommended that the combined weight of components (I) and (II) account for at least 60%, and preferably at least 70%, of the overall weight of the cover-forming resin composition. Components (I) and (II) are described below.

The thermoplastic polyurethane (I) has a structure which includes soft segments composed of a polymeric polyol (polymeric glycol) that is a long-chain polyol, and hard segments composed of a chain extender and a polyisocyanate compound. Here, the long chain polyol serving as a starting material may be any that has hitherto been used in the art relating to thermoplastic polyurethanes, and is not particularly limited. Illustrative examples include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly, or two or more may be used in combination. Of these, in terms of being able to synthesize a thermoplastic polyurethane having a high rebound resilience and excellent low-temperature properties, a polyether polyol is preferred.

Any chain extender that has hitherto been employed in the art relating to thermoplastic polyurethanes may be suitably used as the chain extender. For example, low-molecular-weight compounds with a molecular weight of 400 or less which have on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these, the chain extender is preferably an aliphatic dial having 2 to 12 carbon atoms, and more preferably 1,4-butylene glycol.

Any polyisocyanate compound hitherto employed in the art relating to thermoplastic polyurethanes may be suitably used without particular limitation as the polyisocyanate compound. For example, use may be made of one or more selected from the group consisting of 4,4'-diphenylmethane diisocyanate, 2,4-toluene diisocyanate, 2,6-toluene diisocyanate, p-phenylene diisocyanate, xylylene diisocyanate, 1,5-naphthylene diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. However, depending on the type of isocyanate, the crosslinking reactions during injection molding may be difficult to control. In the practice of the invention, to provide a balance between stability at the time of production and the properties that are manifested, it is most preferable to use the following aromatic diisocyanate: 4,4'-diphenylmethane diisocyarune.

Commercially available products may be used as the thermoplastic polyurethane serving as component (I). Illustrative examples include Pandex® T-8295, Pandex® T-8290 and Pandex® T-8260 tall from DIC Covestro Polymer, Ltd.).

A thermoplastic elastomer other than the above themioplastic polyurethanes may also be optionally included as a separate component, i.e., component (III), together with above components (I) and (II). By including this component (III) in the above resin blend, the flowability of the resin blend can be further improved and properties required of the golf ball cover material, such as resilience and scuff resistance, can be increased.

The compositional ratio of above components (I), (II) and (III) is not particularly limited. However, to fully elicit the advantageous effects of the invention, the compositional ratio (I):(II):(III) is preferably in the weight ratio range of from 100:2:50 to 100:50:0, and more preferably from 100:2:50 to 100:30:8.

In addition, various additives other than the ingredients making up the above thermoplastic polyurethane may be optionally included in this resin blend. For example, pigments, dispersants, antioxidants, light stabilizers, ultraviolet absorbers and internal mold lubricants may be suitably included.

The manufacture of multi-piece solid golf balls in which the above-described core, intermediate layer and cover (outermost layer) are formed as successive layers may be carried out by a customary method such as a known injection molding process. For example, a multi-piece golf ball can be obtained by injection-molding the intermediate layer material over the core so as to obtain an intermediate layer-encased sphere, and then injection-molding the cover material over the intermediate layer-encased sphere. Alternatively, the golf ball can be produced by using two half-cups that have been pre-molded into hemispherical shapes to envelope the core or the intermediate layer-encased sphere with the respective encasing member (i.e., the intermediate layer or the cover) and then molding under applied heat and pressure.

The golf ball of the invention has a deflection when compressed under a final load of 130 kgf from an initial load of 10 kgf which is preferably at least 3.8 mm, more preferably at least 4.0 mm, and even more preferably at least 4.2 mm. The upper limit is preferably not more than 5.0 mm, more preferably not more than 4.7 mm, and even more preferably not more than 4.4 mm. When this value is too small, the spin rate of the ball may rise excessively so that a sufficient distance is not achieved on full shots, or a soft, comfortable feel at impact may not be obtained. On the other hand, when this value is too large, the durability to cracking under repeated impact may worsen or the initial velocity on actual shots may decrease and a good distance may not be obtained, particularly on shots with a driver (W#1).

In this invention, it is critical to set the surface hardness relationship between the intermediate layer-encased sphere and the ball within a specific range, That is, it is critical for the surface hardness of the ball and the surface hardness of the sphere obtained by encasing the core with the intermediate layer (intermediate layer-encased sphere) to satisfy the following condition:

surface hardness (Shore *C* hardness) of ball≤surface hardness (Shore hardness) of intermediate layer-encased sphere.

The value obtained by subtracting the surface hardness of the intermediate layer-encased sphere from the surface hardness of the ball, expressed on the Shore C hardness scale, is preferably 0 or less, more preferably −5 or less, and even more preferably −10 or less. The lower limit in this surface hardness difference is preferably at least −25, more preferably at least −20, and even more preferably at least −15. When this hardness difference is too large (i.e., the above numerical value is more in the positive direction), the ball may become less receptive to spin on approach shots, or the spin rate on full shots may rise, resulting in a shorter distance. On the other hand, when this difference is too small (i.e., the above numerical value is more in the negative direction), adhesion between the cover and the intermediate layer may worsen, as a result of which the cover may cut more readily when the ball is topped.

It is preferable to optimize the deflections of the core and the ball when subjected to a specific load. That is, letting A be the deflection of the core in millimeters when compressed under a final load of 1,275 N (130 kgf) from an initial load of 98 N (10 kgf) and B be the deflection of the golf ball in millimeters when compressed under a final load of 130 kgf from an initial load of 10 kgf, the value A-B is preferably at least 1.0 mm, more preferably at least 1.2 mm, and every more preferably at least 1.3 mm. The upper limit is preferably not more than 1.8 mm, more preferably not more than 1.6 mm, and even more preferably not more than 1.5 mm. When this value is too large, the durability to cracking on repeated impact may worsen. On the other hand, when this value is too small, the spin rate on full shots may rise, as a result of which a good distance may not be achieved.

The ratio between the core and ball deflections under specific loading, i.e., the value B/A, is preferably at least 0.60, more preferably at least 0.65, and even more preferably at least 0.70. This value has an upper limit that is preferably not more than 0.81, more preferably not more than 0.79, and even more preferably not more than 0.77.

When this value is too small, the durability to cracking on repeated impact may worsen. On the other hand, when this value is too large, the spin rate on full shots may rise, as a result of which a good distance may not be achieved.

Numerous dimples may be formed on the outside surface of the cover serving as the outermost layer. The number of dimples arranged on the cover surface is preferably at least 250, more preferably at least 270, and even more preferably at least 300. The upper limit is preferably not more than 370, more preferably not more than 350, and even more preferably not more than 340. When the number of dimples is higher than this range, the ball trajectory may become lower and the distance traveled by the ball may decrease. On the other hand, when the number of dimples is lower that this range, the ball trajectory may become higher and a good distance may not be achieved.

The dimple shapes may be of one type or may be a core combination of two or more types suitably selected from among, for example, circular shapes, oval shapes, various polygonal shapes, dewdrop shapes and other noncircular shapes. When circular dimples are used, the dimple diameter may be set to from about 2.5 mm to about 6.5 mm, and the dimple depth may be set to from 0.08 mm and up to 0.30 mm.

In order for the aerodynamic properties to be fully manifested, it is desirable for the dimple coverage ratio on the spherical surface of the golf ball, i.e., the dimple surface coverage SR, which is the sum of the individual dimple surface areas, each defined by the flat plane circumscribed by the edge of a dimple, as a percentage of the spherical surface area of the ball were the ball to have no dimples thereon, to be set to from 60% to 90%. Also, to optimize the ball trajectory, it is desirable for the value $V_0$, defined as the spatial volume of the individual dimples below the flat plane circumscribed by the dimple edge, divided by the volume of the cylinder whose base is the flat plane and whose height is the maximum depth of the dimple from the base, to be set to from 0.35 to 0.80. Moreover, it is preferable for the ratio VR of the sum of the volumes of the individual dimples, each formed below the flat plane circumscribed by the edge of a dimple, with respect to the volume of the ball sphere were the ball surface to have no dimples thereon, to be set to from 0.6 to 1.0%. Outside of the above ranges in these respective values, the resulting trajectory may not allow a good distance to be achieved and so the ball may fail to travel a satisfactory distance.

A coating layer may be formed on the surface of the cover. This coating layer can be applied using various types of coatings. Because the coating must be capable of enduring the harsh conditions of golf ball use, it is desirable to use a coating composition in which the chief component is a urethane coating composed of a polyol and a polyisocyanate.

The polyol component is exemplified by acrylic polyols and polyester polyols. These polyols include modified polyols. To further increase workability, other polyols may also be added.

It is suitable to use two types of polyester polyols together as the polyol component. Letting the two types of polyester polyol be component (a) and component (b), a polyester polyol in which a cyclic structure has been introduced onto the resin skeleton may be used as the polyester polyol of component (a). Examples include polyester polyols obtained by the polycondensation of a polyol having an alicyclic structure, such as cyclohexane dimethanol, with a polybasic acid; and polyester polyols obtained by the polycondensation of a polyol having an alicyclic structure with a diol or triol and a polybasic acid. A polyester polyol having a branched structure may be used as the polyester polyol of component (b). Examples include polyester polyols having a branched structure, such as NIPPOLAN 800 from Tosoh Corporation.

The polyisocyanate is exemplified by, without particular limitation, commonly used aromatic, aliphatic, alicyclic and other polyisocyanates. Specific examples include tolylene diisocyanate, diphenylmethane diisocyanate, xylylene diisocyanate, tetramethylene diisocyanate, hexamethylene diisocyanate, lysine diisocyanate, isophorone diisocyanate, 1,4-cyclohexylene diisocyanate, naphthalene diisocyanate, trimethylhexamethylene diisocyanate, dicyclohexylmethane diisoeyanate and 1-isocyanato-3,3,5-trimethyl-4-isocyanatomethylcyclohexane. These may be used singly or in admixture.

Depending on the coating conditions, various types of organic solvents may be mixed into the coating composition. Examples of such organic solvents include aromatic solvents such as toluene, xylene and ethylbenzene; ester solvents such as ethyl acetate, butyl acetate, propylene glycol methyl ether acetate and propylene glycol methyl ether propionate; ketone solvents such as acetone, methyl ethyl ketone, methyl isobutyl ketone and cyclohexanone; ether solvents such as diethylene glycol dimethyl ether, diethylene glycol diethyl ether and dipropylene glycol dimethyl ether; alicyclic hydrocarbon solvents such as cyclohexane, methyl cyclohexane and ethyl cyclohexane; and petroleum hydrocarbon solvents such as mineral spirits.

The thickness of the coating layer made of the coating composition, although not particularly limited, is typically from 5 to 40 μm, and preferably from 10 to 20 μm. As used herein, "coating layer thickness" refers to the coating thickness obtained by averaging the measurements taken at a total of three places: the center of a dimple and two places located at positions between the dimple center and the dimple edge.

In this invention, the coating layer made of the above coating composition has an elastic work recovery that is preferably at least 60%, and more preferably at least 80%. At a coating layer elastic work recovery in this range, the coating layer has a high elasticity and so the self-repairing ability is high, resulting in an outstanding abrasion resistance. Moreover, the performance attributes of golf balls coated with this coating composition can be improved. The method of measuring the elastic work recovery is described below.

The elastic work recovery is one parameter of the nanoindentation method for evaluating the physical properties of coating layers, this being a nanohardness test method that controls the indentation load on a micro-newton (μN) order and tracks the indenter depth during indentation to a nanometer (nm) precision. In prior methods, only the size of the deformation (plastic deformation) mark corresponding to the maximum load could be measured. However, in the nanoindentation method, the relationship between the indentation load and the indentation depth can be obtained by continuous automated measurement. Hence, unlike in the past, there are no individual differences between observers when visually measuring a deformation mark under an optical microscope, thus enabling the physical properties of the coating layer to be measured to a high precision. Given that the coating layer on the ball surface is strongly affected by the impact of drivers and various other clubs and has a not inconsiderable influence on various golf ball properties, measuring the coating layer by the nanohardness test method and carrying out such measurement to a higher precision than in the past is a very effective method of evaluation.

The hardness of the coating layer, expressed on the Shore M hardness scale, is preferably at least 40, and more preferably at least 60. The upper limit is preferably not more than 95, and more preferably not more than 85. This Shore M hardness is obtained in general accordance with ASTM D2240. The hardness of the coating layer, expressed on the Shore C hardness scale, is preferably at least 40 and has an upper limit of preferably not more than 80. This Shore C hardness is obtained in general accordance with ASTM D2240. At coating layer hardnesses that are higher than these ranges, the coating may become brittle when the ball is repeatedly struck, which may make it incapable of protecting the cover layer. On the other hand, coating layer hardnesses that are lower than the above range are undesirable because the ball surface scuffs more readily upon striking a hard object.

The value obtained by subtracting the Shore C hardness of the coating layer from the material hardness (Shore C hardness) of the cover is preferably at least −20, more preferably at least −15, and even more preferably at least −10. The upper limit is preferably not more than 30, more preferably not more than 20, and even more preferably not more than 10. When this value is outside of the foregoing range, the spin rate of the ball on full shots may rise, as a result of which a good distance may not be obtained.

When the above coating composition is used, the formation of a coating layer on the surface of golf balls manufactured by a commonly known method can be carried out via the steps of preparing the coating composition at the time of application, applying the composition to the golf ball surface by a conventional coating operation, and drying the applied composition. The coating method is not particularly limited. For example, spray painting, electrostatic painting or dipping may be suitably used.

In this invention, in an impact test carried out by striking the ball with a driver at a head speed of 40 m/s, it is critical for the sum t1+t2 of the time t1 required from contact initiation between the driver and the ball for deformation of the ball to reach a maximum value and the time t2 required from the state of maximum golf ball deformation for the ball and driver clubface to separate to be at least 705 microseconds.

Specifically, a golf swing robot is fitted with a metal head driver (W#1) produced by Bridgestone Sports Co., Ltd. under the product name PHYZ (loft angle, 10.5°) and the golf ball is struck at a head speed (HS) of 40 m/s. The golf ball during impact is photographed using a high-speed video camera (FASTCAM SA-Z, from Photron, Ltd.), the captured images are analyzed and the above deformation times t1 and t2 are determined. Also, using images of the impact taken from a directly lateral position, the instant at which the diameter of the golf ball in the direction of flight from the plane of to contact between the clubface and the ball reaches a minimum is treated as the moment of greatest deformation by the ball.

Deformation time t1 is preferably at least 280 microseconds, more preferably at least 290 microseconds, and even more preferably at least 295 microseconds. The upper limit is preferably not more than 320 microseconds, more preferably not more than 310 microseconds, and even more preferably not more than 300 microseconds. When this value is too small, particularly on full shots with an iron, the spin rate may become too high and a good distance may not be achieved, or the feel at impact may worsen. On the other hand, when this value is too large, the initial velocity may be low and a good distance may not be achieved.

Deformation time t2 is preferably at least 410 microseconds, more preferably at least 425 microseconds, and even more preferably at least 435 microseconds. The upper limit is preferably not more than 490 microseconds, more preferably not more than 470 microseconds, and even more preferably not more than 450 microseconds. When this value is too small, particularly on full shots with an iron, the spin rate may become too high and a good distance may not be achieved, or the feel at impact may worsen. On the other hand, when this value is too large, the initial velocity may be low and a good distance may not be achieved.

The ratio of deformation time t2 to deformation time t1 (t2/t1) is preferably at least 1.35, more preferably at least 1.38, and even more preferably at least 1.41, The upper limit is preferably not more than 1.80, more preferably not more than 1.70, and even more preferably not more than 1,60. When this value is too small, particularly on full shots with an iron, the spin rate may become too high and a good distance may not be achieved, or the feel at impact may worsen. On the other hand, when this value is too large, the initial velocity may be low and a good distance may not be achieved.

The sum of deformation times t1 and t2 is preferably at least 705 microseconds, more preferably at least 710 microseconds, and even more preferably at least 715 microseconds. The upper limit is preferably not more than 800 microseconds, more preferably not more than 780 microseconds, and even more preferably not more than 760 microseconds. When this value is too small, particularly on full shots with an iron, the spin rate may become too high and a good distance may not be achieved, or the feel at impact may worsen. On the other hand, when this value is too large, the initial velocity may be low and a good distance may not be achieved.

In order to fully achieve the desired effects of this invention, it is advantageous to try optimizing in the manner shown below the thickness relationships among the respective layers and the surface hardness relationships among, the respective layer-encased spheres in the golf ball of the invention.

It is preferable to set the combined thickness of the cover and the intermediate layer in a specific range. That is, the combined thickness of the cover and the intermediate layer is preferably at least 1.4 mm, more preferably at least 1.7 mm, and even more preferably at least 2.0 mm. The upper limit in this combined thickness is preferably not more than 2.8 mm, more preferably not more than 2.5 mm and even more preferably not more than 2.3 mm. When this combined thickness is smaller than the above range, the durability to cracking on repeated impact may worsen, or the feel at impact may worsen. On the other hand, when the combined thickness is larger than the above range, the spin rate on full shots may rise and a good distance may not be achieved.

It is also preferable to set the surface hardness relationship between the intermediate layer-encased sphere and the core within a specific range. That is, the value obtained by subtracting the core surface hardness from the surface hardness of the intermediate layer-encased sphere, on the Shore C hardness scale, is preferably at least 5, more preferably at least 15, and even more preferably at least 20. The upper limit is preferably not more than 40, more preferably not more than 35, and even more preferably not more than 30. When this value is too large, the durability to cracking on repeated impact may worsen. On the other hand, when this value is too small, the spin rate on full shots may rise and a good distance may not be achieved.

The multi-piece solid golf ball of the invention can be made to conform to the Rules of Golf for play. The inventive ball may be formed to a diameter which is such that the ball does not pass through a ring having an inner diameter of 42.672 mm and is not more than 42.80 mm, and to a weight which is preferably between 45.0 and 45.93 g.

EXAMPLES

The following Examples and Comparative Examples are provided to illustrate the invention, and are not intended to limit the scope thereof.

Examples 1 to 3, Comparative Examples 1 to 5

Formation of Core

Solid cores were produced by preparing rubber compositions for the respective Examples and Comparative Examples shown in Table 1, and then molding/vulcanizing the compositions under vulcanization conditions of 155° C. and 15 minutes.

TABLE 1

| Core formulation | Example | | | Comparative Example | | | | |
|---|---|---|---|---|---|---|---|---|
| (pbw) | 1 | 2 | 3 | 1 | 2 | 3 | 4 | 5 |
| Polybutadiene | 100 | 100 | 100 | 100 | 100 | 100 | 100 | 100 |
| Zinc acrylate | 30.9 | 28.5 | 27.4 | 30.9 | 32.0 | 34.4 | 35.6 | 36.8 |
| Organic peroxide | 1.0 | 1.0 | 1.0 | 1.0 | 1.0 | 1.0 | 1.0 | 1.0 |
| Water | 1.0 | 1.0 | 1.0 | 1.0 | 1.0 | 1.0 | 1.0 | 1.0 |
| Antioxidant | 0.1 | 0.1 | 0.1 | 0.1 | 0.1 | 0.1 | 0.1 | 0.1 |
| Zinc oxide | 17.3 | 18.4 | 18.8 | 20.5 | 16.6 | 10.1 | 15.4 | 9.1 |
| Zinc salt of pentachlorothiophenol | 1.0 | 1.0 | 1.0 | 1.0 | 1.0 | 1.0 | 1.0 | 1.0 |

Details on the ingredients mentioned in Table 1 are given below.

Polybutadiene: Available under the trade name "BR 730" from JSR Corporation

Zinc acrylate: Available as "ZN-DA85S" from Nippon Shokubai Co., Ltd.

Organic Peroxide: Dicumyl peroxide, available under the trade name "Percumyl D" from NOF Corporation Water: Pure water (from Seiki Chemical Industrial Co., Ltd.)

Antioxidant: 2,2-Methylenebis(4-methyl-6-butylphenol), available under the trade name "Nocrac NS-6" from Ouchi Shinke Chemical industry Co., Ltd.

Zinc oxide: Available as "Zinc Oxide Grade 3" from Sakai Chemical Co., Ltd.

Zinc salt of pentachlorothiophenol: Available from Wake Pure Chemical Industries, Ltd.

An intermediate layer was formed by injection-molding Resin Material No. 1, No. 2 or No. 3 formulated as shown in Table 2 over the core, thereby giving an intermediate layer-encased sphere (except in Comparative Example 5). Next, a cover (outermost layer) was formed by injection-molding Resin Material No. 4, No. 5 or No. 6 formulated as shown in Table 2 over the intermediate layer-encased sphere, A plurality of given dimples common to all the Examples and Comparative Examples were formed at this time on the cover surface.

TABLE 2

| Resin composition (pbw) | No. 1 | No. 2 | No. 3 | No. 4 | No. 5 | No. 6 |
|---|---|---|---|---|---|---|
| Himilan ® 1605 | 50 | 40 | | | | |
| Himilan ® 1557 | 15 | | | | | |

TABLE 2-continued

| Resin composition (pbw) | No. 1 | No. 2 | No. 3 | No. 4 | No. 5 | No. 6 |
|---|---|---|---|---|---|---|
| Himilan ® 1706 | 35 | | | | | |
| Surlyn ® 9320 | | | | 50 | | |
| Surlyn ® 8120 | | | | 50 | | |
| HPF ® 1000 | | 60 | | | | |
| T-8295 | | | | | | 100 |
| T-8283 | | | | | 100 | |
| Hytrel ® 4001 | | | 100 | | | 11 |
| Polytail ™ H | | 4.0 | | | | |
| Trimethylolpropane | 1.1 | | | | | |
| Titanium oxide | | | | 4.0 | 3.9 | 3.9 |
| Polyethylene wax | | | | | 1.2 | 1.2 |
| Isocyanate compound | | | | | 7.5 | 7.5 |

Trade names of the chief materials in the above table are given below.

Himilan®: Ionomers available from DuPont-Mitsui Polychemicals Co., Ltd.

Surlyn®: Ionomers available from E.I. DuPont de Nemours & Co.

HPF® 1000: Available from E.I. DuPont de Nemours & Co.

T-8295, T-8283: Ether-type thermoplastic polyurethanes available under the trade name Pandex® from DIC Covestro Polymer, Ltd.

Hytrel® 4001: A polyester elastomer available from DuPont-Toray Co., Ltd.

Polytail™ H: A polyhrdroxy hydrocarbon-based polymer available from Mitsubishi Chemical Corporation Trimethylolpropane: Available from Tokyo Chemical Industry Titanium oxide: Available from Sakai Chemical Industry Co., Ltd.

Polyethylene wax: Available under the trade name "Sanwax 161P" from Sanyo Chemical Industries, Ltd.

Isocyanate compound: 4,4-Diphenylmethane diisocyanate

Formation of Coating layer

Next, as a coating composition common to all the Examples and Comparative Examples, Coating Composition I shown in Table 3 below was applied with an air spray gun onto the cover (outermost layer) surface on which numerous dimples had been formed, thereby producing golf balls having a 15 μm-thick coating layer thereon.

TABLE 3

| Coating composition I (pbw) | Base resin | Polyester Polyol (A) | 23 |
|---|---|---|---|
| | | Polyester Polyol (B) | 15 |
| | | Organic solvent | 62 |

TABLE 3-continued

| | | | |
|---|---|---|---|
| | Curing agent | Isocyanate (HMDI isocyanurate) | 42 |
| | | Solvent | 58 |
| | Molar blending ratio (NCO/OH) | | 0.89 |
| Coating properties | Elastic work recovery (%) | | 84 |
| | Shore M hardness | | 84 |
| | Shore C hardness | | 63 |
| | Thickness (μm) | | 15 |

Polyester Polyol (A) Synthesis Example

A reactor equipped with a reflux condenser, a dropping funnel, a gas inlet and a thermometer was charged with 140 parts by weight of trimethylolpropane, 95 parts by weight of ethylene glycol, 157 parts by weight of adipic acid and 58 parts by weight of 1,4-cyclohexanedimethanol, following which the temperature was raised to between 200 and 240° C. under stirring and the reaction was effected by 5 hours of heating. This yielded Polyester Polyol (A) having an acid value of 4, a hydroxyl value of 170 and a weight-average molecular weight (Mw) of 28,000.

Next, Polyester Polyol (A) synthesized above was dissolved in butyl acetate, thereby preparing a varnish having a nonvolatiles content of 70 wt %.

The base resin for Coating Composition I in Table 3 was prepared by mixing 23 parts by weight of the above polyester polyol solution together with 15 parts by weight of Polyester Polyol (B) (the saturated aliphatic polyester polyol NIPPOLAN 800 from Tosoh Corporation; weight-average molecular weight (Mw), 1,000; 100% solids) and the organic solvent. This mixture had a nonvolatiles content of 38.0 wt %.

Elastic Work Recovery

The elastic work recovery of the coating material was measured using a coating sheet having a thickness of 50 μm. The ENT-2100 nanohardness tester from Erionix Inc. was used as the measurement apparatus, and the measurement conditions were as follows.

Indenter: Berkovich indenter (material: diamond; angle α: 65.03°)

Load F: 0.2 mN

Loading time: 10 seconds

Holding time: 1 second

Unloading time: 10 seconds

The elastic work recovery was calculated as follows, based on the indentation work $W_{elast}$ (Nm) due to spring-back deformation of the coating and on the mechanical indentation work $W_{total}$ (Nm).

$$\text{Elastic work recovery}=W_{elast}/W_{total}\times 100(\%)$$

Shore C Hardness and Shore M Hardness

The Shore C hardness and Shore M hardness in Table 3 above were determined by fabricating the material being tested into 2 mm thick sheets and stacking three such sheets together to form test specimens. Measurements were taken using a Shore C durometer and a Shore M durometer in accordance with ASTM D2240.

Various properties of the resulting golf balls, including the interior hardnesses at various positions in the core, the surface hardnesses of the core, the intermediate layer-encased sphere and the hail, the thicknesses and material hardnesses of the respective layers, the deflections of the core and the ball under specific loads, and the ball deformation time when struck with a driver, were evaluated by the following methods. The results are presented in Tables 4 and 5.

Diameters of Core and Intermediate Layer-Encased Sphere

The diameter at five random places on the surface was measured after holding the test specimen isothermally at 23.9±1° C. for at least 3 hours. Using the average of these measurements as the measured value for a single core or intermediate layer-encased sphere, the average diameter for ten such spheres was determined.

Ball Diameter

The diameter at 15 random dimple-free areas was measured after holding the test specimen isothermally at 23.9±1° C. for at least 3 hours. Using the average of these measurements as the measured value for a single ball, the average diameter for ten balls was determined.

Core Hardness Profile

The indenter of a durometer was set substantially perpendicular to the spherical surface of the core, and the surface hardness of the core on the Shore C hardness scale was measured in accordance with ASTM D2240. Cross-sectional hardnesses at the center of the core and at given positions in the core were measured by perpendicularly pressing the indenter of a durometer against the place to be measured in the flat cross-section obtained by cutting the core into hemispheres. The measurement results are indicated as Shore C hardness values.

In addition, letting Cc be the Shore C hardness at the core center, Cs be the Shore C hardness at the core surface, $C_M$ be the Shore C hardness at a midpoint M between the core center and surface, $C_{M+2.5}$, $C_{M+5.0}$ and $C_{M+7.5}$ be the respective Shore C hardnesses at positions 2.5 mm, 5.0 mm and 7.5 mm from the midpoint M toward the core surface side and $C_{M-2.5}$, $C_{M-5.0}$ and $C_{M-7.5}$ be the respective Shore C hardnesses at positions 2.5 mm, 5.0 mm and 7.5 mm from the midpoint M toward the core center side, the surface areas A to F defined as follows surface area A: $\frac{1}{2}\times 2.5\times(C_{M-5.0}-C_{M-7.5})$ surface area B: $\frac{1}{2}\times 2.5\times(C_{M-2.5}-C_{M-5.0})$ surface area C: $\frac{1}{2}\times 2.5\times(C_{M}-C_{M-2.5})$ surface area D: $\frac{1}{2}\times 2.5\times(C_{M+2.5}-C_{M})$ surface area E: $\frac{1}{2}\times 2.5\times(C_{M+5.0}-C_{M+2.5})$ surface area F: $\frac{1}{2}\times 2.5\times(C_{M+7.5}-C_{M+5.0})$ were calculated, and the values of the following three expressions were determined:

(surface area *D*+surface area *E*+surface area *F*)−(surface area *A*+surface area *B*+surface area *C*);

(surface area *D*+surface area *E*)−(surface area *A*+surface area *B*+surface area *C*);

[(surface area *D*+surface area *E*+surface area *F*)−(surface area *A*+surface area *B*+surface area *C*)]/(*Cs*−*Cc*).

Surface areas A to F in the core hardness profile are explained in FIG. 2, which is a graph that illustrates surface areas A to F using the core hardness profile data from Example 1.

Material Hardnesses (Shore C and Shore D Hardnesses) of Intermediate Layer and Cover The resin materials for each layer were molded into sheets having a thickness of 2 mm and left to stand for at least two weeks, following which the Shore C and Shore D hardnesses were measured in accordance with ASTM D2240.

Surface Hardnesses (Shore C and Shore D Hardnesses) of Intermediate Layer-Encased Sphere and Ball The surface hardnesses were measured by perpendicularly pressing an indenter against the surfaces of the respective spheres. The surface hardnesses of the balls (covers) were values measured at dimple-free areas (lands) on the surface of the ball. Shore D hardnesses were measured with a type D durometer in accordance with ASTM D2240, and Shore C hardnesses were measured with a type C durometer in accordance with ASTM D2240.

Deflections of Core and Ball

A sphere (i.e., a core or a ball) was placed on a hard plate and the deflection of the sphere when compressed under a final load of 130 kgf from an initial load of 10 kgf was measured. The deflection refers in each case to a measured value obtained after holding the test specimen isothermally at 23.9° C. The instrument used was a high-load compression tester available from MU Instruments Trading Corporation. Measurement was carried out with the pressing head moving downward at a speed of 4.7 mm/s.

Ball Deformation Times

A golf swing robot was fitted with a metal head driver (W#1) produced by Bridgestone Sports Co., Ltd. under the product name PHYZ (loft angle, 10.5°) and the golf ball was struck at a head speed (HS) of 40 m/s. The golf ball during impact was photographed using a high-speed video camera (FASTCAM SA-Z, from Photron. Ltd), the captured images were analyzed and the following two times were measured in microseconds: the time t1 required from contact initiation between the driver and the ball for deformation of the ball to reach a maximum value and the time t2 required from the state of maximum ball deformation for the ball and driver clubface to separate. Also, using images of the impact taken from a directly lateral position, the instant at which the diameter of the ball in the direction of flight from the plane of contact between the clubface and the ball reached a minimum was treated as the moment of greatest deformation by the ball.

TABLE 4

| | | Example | | | Comparative Example | | | | |
|---|---|---|---|---|---|---|---|---|---|
| | | 1 | 2 | 3 | 1 | 2 | 3 | 4 | 5 |
| Ball construction | | 3-piece | 3-piece | 3-piece | 3-piece | 3-piece | 3-piece | 3-piece | 2-piece |
| Core | Diameter (mm) | 38.7 | 38.7 | 38.7 | 38.7 | 38.7 | 38.7 | 38.7 | 39.7 |
| | Weight (g) | 35.1 | 35.1 | 35.1 | 35.7 | 35.1 | 34.1 | 35.1 | 36.8 |
| | Deflection (mm) | 5.3 | 5.7 | 5.9 | 5.3 | 5.0 | 4.7 | 4.5 | 4.3 |
| Core hardness profile | Surface hardness (Cs) | 75 | 72 | 71 | 75 | 77 | 79 | 80 | 81 |
| | Hardness 7.5 mm toward core surface side from midpoint M ($C_{M+7.5}$) | 72 | 70 | 69 | 72 | 74 | 76 | 77 | 79 |
| | Hardness 5 mm toward core surface side from midpoint M ($C_{M+5}$) | 69 | 66 | 65 | 69 | 70 | 72 | 73 | 74 |
| | Hardness 2.5 mm toward core surface side from midpoint M ($C_{M+2.5}$) | 63 | 62 | 61 | 63 | 64 | 65 | 66 | 68 |
| | Hardness at midpoint M between core center and surface ($C_M$) | 59 | 57 | 57 | 59 | 60 | 61 | 62 | 63 |
| | Hardness 2.5 mm toward core center side from midpoint M ($C_{M-2.5}$) | 56 | 54 | 53 | 56 | 57 | 58 | 59 | 60 |
| | Hardness 5 mm toward core center side from midpoint M ($C_{M-5}$) | 53 | 51 | 50 | 53 | 55 | 56 | 57 | 58 |
| | Hardness 7.5 mm toward core center side from midpoint M ($C_{M-7.5}$) | 50 | 49 | 48 | 50 | 52 | 54 | 55 | 55 |
| | Center hardness (Cc) | 49 | 46 | 45 | 49 | 50 | 52 | 54 | 54 |
| | Surface hardness − Center hardness (Cs − Cc) | 26 | 26 | 26 | 26 | 26 | 27 | 27 | 27 |
| | Surface area A: ½ × 2.5 × ($C_{M-5}$ − $C_{M-7.5}$) | 3.7 | 3.0 | 3.0 | 3.7 | 3.4 | 3.0 | 2.8 | 3.3 |
| | Surface area B: ½ × 2.5 × ($C_{M-2.5}$ − $C_{M-5}$) | 2.8 | 3.0 | 3.1 | 2.8 | 2.6 | 2.4 | 2.3 | 2.9 |
| | Surface area C: ½ × 2.5 × ($C_M$ − $C_{M-2.5}$) | 3.8 | 4.4 | 4.6 | 3.8 | 3.5 | 3.1 | 2.8 | 3.8 |
| | Surface area D: ½ × 2.5 × ($C_{M+2.5}$ − $C_M$) | 5.4 | 5.6 | 5.6 | 5.4 | 5.3 | 5.2 | 5.1 | 6.3 |
| | Surface area E: ½ × 2.5 × ($C_{M+5}$ − $C_{M+2.5}$) | 6.9 | 5.8 | 5.3 | 6.9 | 7.6 | 8.4 | 8.9 | 7.5 |
| | Surface area F: ½ × 2.5 × ($C_{M+7.5}$ − $C_{M+5}$) | 0.9 | 0.9 | 0.9 | 0.9 | 0.9 | 0.9 | 1.0 | 1.3 |
| | Surface areas A + B + C | 10.3 | 10.4 | 10.7 | 10.3 | 9.4 | 8.5 | 7.9 | 10.0 |
| | Surface areas D + E | 12.3 | 11.4 | 10.9 | 12.3 | 13.0 | 13.6 | 14.1 | 13.8 |
| | Surface areas D + E + F | 13.2 | 12.3 | 11.8 | 13.2 | 13.9 | 14.6 | 15.0 | 15.0 |
| | (Surface areas D + E + F) − (Surface areas A + B + C) | 2.8 | 1.9 | 1.1 | 2.8 | 4.4 | 6.0 | 7.1 | 5.0 |
| | (Surface areas D + E) − (Surface areas A + B + C) | 1.9 | 1.0 | 0.2 | 1.9 | 3.5 | 5.1 | 6.2 | 3.8 |
| | [(Surface areas D + E + F) − (Surface areas A + B + C)]/(Cs − Cc) | 0.11 | 0.07 | 0.04 | 0.11 | 0.17 | 0.23 | 0.27 | 0.19 |

TABLE 5

| | | | Example | | | Comparative Example | | | | |
|---|---|---|---|---|---|---|---|---|---|---|
| | | | 1 | 2 | 3 | 1 | 2 | 3 | 4 | 5 |
| Intermediate layer | Material | type | No. 1 | No. 1 | No. 1 | No. 1 | No. 2 | No. 3 | No. 1 | — |
| | Thickness | mm | 1.2 | 1.2 | 1.2 | 1.2 | 1.2 | 1.2 | 1.2 | — |
| | Material hardness (sheet hardness) | Shore D | 64 | 64 | 64 | 64 | 54 | 40 | 64 | — |
| | | Shore C | 95 | 95 | 95 | 95 | 82 | 63 | 95 | — |
| Intermediate layer-encased sphere | Diameter | mm | 41.1 | 41.1 | 41.1 | 41.1 | 41.1 | 41.1 | 41.1 | — |
| | Weight | g | 40.8 | 40.8 | 40.8 | 41.4 | 40.8 | 40.8 | 40.8 | — |
| | Surface hardness | Shore D | 69 | 69 | 69 | 69 | 60 | 46 | 69 | — |
| | | Shore C | 98 | 98 | 98 | 98 | 89 | 71 | 98 | — |

TABLE 5-continued

| | | | Example | | | Comparative Example | | | | |
|---|---|---|---|---|---|---|---|---|---|---|
| | | | 1 | 2 | 3 | 1 | 2 | 3 | 4 | 5 |
| Intermediate layer surface hardness − Core surface hardness | | Shore C | 23 | 26 | 27 | 23 | 13 | −8 | 18 | — |
| Cover material | Material | type | No. 5 | No. 5 | No. 5 | No. 4 | No. 6 | No. 5 | No. 5 | No. 5 |
| | Thickness | mm | 0.8 | 0.8 | 0.8 | 0.8 | 0.8 | 0.8 | 0.8 | 1.5 |
| | Material hardness | Shore D | 41 | 41 | 41 | 41 | 57 | 41 | 41 | 41 |
| | (sheet hardness) | Shore C | 64.5 | 64.5 | 64.5 | 64.5 | 85.5 | 64.5 | 64.5 | 64.5 |
| Cover thickness + Intermediate layer thickness | | mm | 2.0 | 2.0 | 2.0 | 2.0 | 2.0 | 2.0 | 2.0 | 1.5 |
| Cover material hardness − Intermediate layer material hardness | | Shore C | −30 | −30 | −30 | −30 | 4 | 1 | −30 | — |
| Coating | Material | type | 1 | 1 | 1 | 1 | 1 | 1 | 1 | 1 |
| | Sheet hardness | Shore C | 62.5 | 62.5 | 62.5 | 62.5 | 62.5 | 62.5 | 62.5 | 62.5 |
| Cover material hardness − Coating material hardness | | Shore C | 2.0 | 2.0 | 2.0 | 2.0 | 23.0 | 2.0 | 20 | 2.0 |
| Ball | Diameter | mm | 42.7 | 42.7 | 42.7 | 42.7 | 42.7 | 42.7 | 42.7 | 42.7 |
| | Weight | g | 45.5 | 45.5 | 45.5 | 45.5 | 45.5 | 45.5 | 45.5 | 45.5 |
| | Deflection | mm | 4.0 | 4.3 | 4.4 | 4.0 | 4.0 | 4.0 | 3.4 | 4.0 |
| | Surface hardness | Shore D | 59 | 59 | 59 | 59 | 64 | 47 | 59 | 47 |
| | | Shore C | 85 | 85 | 85 | 85 | 93 | 72 | 85 | 72 |
| | Deformation time t1 | μs | 296 | 298 | 299 | 294 | 295 | 296 | 291 | 297 |
| | Deformation time t2 | μs | 424 | 442 | 448 | 425 | 424 | 425 | 389 | 424 |
| | Ratio between deformation times (t2/t1) | | 1.43 | 1.48 | 1.50 | 1.45 | 1.44 | 1.44 | 1.34 | 1.4.3 |
| | Sum of deformation times (t1 + t2) | μs | 719 | 741 | 748 | 719 | 719 | 721 | 680 | 721 |
| Ball surface hardness − Intermediate layer surface hardness | | Shore C | −13.0 | −13.0 | −13.0 | −13.0 | 3.1 | 1.4 | −13.0 | — |
| Core deflection/Ball deflection | | | 0.75 | 0.75 | 0.75 | 0.75 | 0.80 | 0.85 | 0.76 | 0.93 |
| Core deflection − Ball deflection | | mm | 1.3 | 1.4 | 1.5 | 1.3 | 1.0 | 0.7 | 1.1 | 0.3 |

The flight performance and feel at impact of each golf ball were evaluated by the following methods. The results are shown in Table 7.

Flight Performance

Various clubs (W#1, I#6) were mounted on a golf swing robot and the distances traveled by the ball when struck under the conditions shown in Table 6 below were measured and rated according to the criteria in the table.

TABLE 6

| | | W#1 | I#6 |
|---|---|---|---|
| Club used | Product name | PHYZ | PHYZ |
| | Conditions | HS, 40 m/s | HS, 34 m/s |
| Rating criteria | Good | ≥200.0 m | ≥134.0 m |
| | NG | <200.0 m | <134.0 m |

The clubs referred to in the above table as "PHYZ" were the PHYZ Driver (loft angle, 10.5°) and the PHYZ Iron I#6, both manufactured by Bridgestone Sports Co., Ltd.

Spin Rate on Approach Shots

A sand wedge (SW) was mounted on a golf swing robot and the spin rate of the ball when struck at a head speed of 20 m/s was rated according to the following criteria. The club used was the TourB XW-1 SW manufactured by Bridgestone Sports Co., Ltd.

Good: Spin rate was at least 5,700 rpm

NG: Spin rate was less than 5,700 rpm

Feel

The "soft feel" of the ball on full shots with a driver (W#1) taken by amateur golfers having head speeds of 30 to 40 m/s were rated according to the following criteria.

Good: Twelve or more out of 20 golfers rated the ball as having a soft feel

Fair: At least 7 and up to 11 out of 20 golfers rated the ball as having a soft feel NG: Six or fewer out of 20 golfers rated the ball as having a soft feel Scuff Resistance A wedge having a loft angle of 52° and square grooves etched into the clubface was mounted on a golf swing robot, and the scuff resistance of the ball when struck at a head speed (HS) of 40 m/s was rated according to the following criteria.

Good: The resistance to scuffing was comparable to or better than that of the ball in Example 1

NG: Scuffing was more pronounced than in Example 1

TABLE 7

| | | | Example | | | Comparative Example | | | | |
|---|---|---|---|---|---|---|---|---|---|---|
| | | | 1 | 2 | 3 | 1 | 2 | 3 | 4 | 5 |
| Flight | W#1 | Spin rate (rpm) | 2,795 | 2,730 | 2,709 | 2,889 | 2,774 | 3,033 | 2,920 | 2,915 |
| | HS, 40 m/s | Total distance (m) | 200.5 | 201.1 | 201.8 | 199.1 | 202.2 | 198.8 | 199.3 | 198.7 |
| | | Rating | good | good | good | NG | good | NG | fair | NG |
| | I#6 | Spin rate (rpm) | 5,056 | 4,900 | 4,848 | 5,164 | 4,952 | 5,630 | 5,358 | 5,345 |
| | HS, 34 m/s | Total distance (m) | 134.2 | 135.2 | 135.6 | 133.5 | 134.9 | 130.6 | 132.3 | 132.4 |
| | | Rating | good | good | good | NG | good | NG | NG | NG |

TABLE 7-continued

| | | Example | | | Comparative Example | | | | |
|---|---|---|---|---|---|---|---|---|---|
| | | 1 | 2 | 3 | 1 | 2 | 3 | 4 | 5 |
| Approach shots HS, 20 m/s | Spin rate (rpm) | 5,896 | 5,804 | 5,778 | 5,844 | 5,597 | 6,093 | 6,070 | 6,101 |
| | Rating | good | good | good | good | NG | good | good | good |
| Feel at impact (soft feel) | Rating | good | good | good | good | good | good | NG | good |
| Scuff resistance | | good (reference) | good | good | NG | NG | good | good | good |

As demonstrated by the results in Table 7, the golf balls of Comparative Examples 1 to 5 were inferior in the following respects to the golf balls according to the present invention that were obtained in the Examples.

In Comparative Example 1, the cover material was composed primarily of an ionomer resin. As a result, the ball had an inferior scuff resistance and a poor distance.

In Comparative Example 2, the ball surface hardness was higher than the intermediate layer surface hardness. As a result, the ball had a low spin rate on approach shots and the cover scuffed easily.

In Comparative Example 3, the ball surface hardness was higher than the intermediate layer surface hardness and the intermediate layer was soft. As a result, the spin rate increased on full shots and the distance was inferior.

In Comparative Example 4, the ball deformation time (t1+t2) on shots with a driver was less than 705 μs and the spin rate on full shots rose, resulting in a poor distance particularly on shots with an iron. In addition, the feel at impact was hard.

In Comparative Example 5, the ball had a two-piece construction consisting of a core encased by a single-layer cover. As a result, the ball had a high spin rate and a poor distance.

Japanese Patent Application No. 2019-081161 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A multi-piece solid golf ball comprising a core, an intermediate layer and a cover, wherein the core is formed of a rubber composition, the cover is formed primarily of a polyurethane material, the ball has a surface hardness and the sphere obtained by encasing the core with the intermediate layer (intermediate layer-encased sphere) has a surface hardness which together satisfy the following condition surface hardness (Shore *C* hardness) of ball≤surface hardness (Shore *C* hardness) of intermediate layer-encased sphere, and in an impact test carried out by striking the ball with a driver at a head speed of 40 m/s, the sum t1+t2 of the time t1 required from contact initiation between the driver and the ball for deformation of the ball to reach a maximum value and the time t2 required from the state of maximum ball deformation for the ball and driver clubface to separate is at least 705 microseconds, and wherein the core has a hardness profile in which, letting Cc be the Shore C hardness at the core center, Cs be the Shore C hardness at a surface of the core, $C_M$ be the Shore C hardness at a midpoint M between the center and surface of the core, $C_{M+2.5}$, $C_{M+5.0}$ and $C_{M+7.5}$ be the respective Shore C hardnesses at positions 2.5 mm, 5.0 mm and 7.5 mm from the midpoint M toward the core surface side and $C_{M-2.5}$, $C_{M-5.0}$ and $C_{M-7.5}$ be the respective Shore C hardnesses at positions 2.5 mm, 5.0 mm and 7.5 mm from the midpoint M toward the core center side, the following surface areas A to F:

surface area A: $\frac{1}{2}\times 2.5\times(C_{M-5.0}-C_{M-7.5})$ surface area B: $\frac{1}{2}\times 2.5\times(C_{M-2.5}-C_{M-5.0})$ surface area C: $\frac{1}{2}\times 2.5\times(C_{M}-C_{M-2.5})$ surface area D: $\frac{1}{2}\times 2.5\times(C_{M+2.5}-C_{M})$ surface area E: $\frac{1}{2}\times 2.5\times(C_{M+5}-C_{M+2.5})$ surface area F: $\frac{1}{2}\times 2.5\times(C_{M+7.5}-C_{M+5})$ satisfy the condition (surface area *D*+surface area *E*+surface area *F*)−(surface area *A*+surface area *B*+surface area *C*)>0.

2. The golf ball of claim 1, wherein the ratio t2/t1 between deformation time t1 and deformation time t2 is at least 1.35.

3. The golf ball of claim 1, wherein the ball has a deflection of at least 3.8 mm when compressed under a final load of 1,275 N (130 kgf) from an initial load of 98 N (10 kgf).

4. The golf ball of claim 1, wherein the core has a center hardness Cc and a surface hardness Cs such that the difference therebetween (Cs−Cc) on the Shore C hardness scale is at least 20.

5. The golf ball of claim 1, wherein surface areas A to F in the core hardness profile satisfy the condition (surface area *D*+surface area *E*)−(surface area *A*+surface area *B*+surface area *C*)≥0.

6. The golf ball of claim 1, wherein surface areas A to F in the core hardness profile satisfy the condition 0<[(surface area *D*+surface area *E*+surface area *F*)−(surface area *A*+surface area *B*+surface area *C*)]/(*Cs*−*Cc*)≤0.60.

7. The golf ball of claim 1, wherein the cover has a surface on which a coating layer is formed, which coating layer has a Shore C hardness of from 40 to 80.

8. The golf ball of claim 7, wherein the value obtained by subtracting the Shore C hardness of the coating layer from a Shore C material hardness of the cover is at least −20 and not more than +30.

9. The golf ball of claim 1 wherein, letting A be the deflection of the core in millimeters when compressed under a final load of 1,275 N (130 kgf) from an initial load of 98 N (10 kgf) and B be the deflection of the ball in millimeters when compressed under a final load of 130 kgf from an initial load of 10 kgf, the ratio B/A is at least 0.60 and not more than 0.81.

* * * * *